US008455408B2

(12) United States Patent
Hori et al.

(10) Patent No.: US 8,455,408 B2
(45) Date of Patent: Jun. 4, 2013

(54) ANTI-SEIZURE AGENT FOR HOT STEEL WORKING

(75) Inventors: Hirofumi Hori, Osaka (JP); Tetsuya Nakanishi, Osaka (JP); Teruo Onozawa, Tokyo (JP); Yoshimi Imoto, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/572,340

(22) Filed: Aug. 10, 2012

(65) Prior Publication Data

US 2012/0304722 A1 Dec. 6, 2012

Related U.S. Application Data

(62) Division of application No. 11/887,512, filed as application No. PCT/JP2006/306200 on Mar. 27, 2006, now Pat. No. 8,263,534.

(30) Foreign Application Priority Data

Mar. 31, 2005 (JP) ..... 2005-105360

(51) Int. Cl.
*C10M 125/10* (2006.01)
*C10M 125/26* (2006.01)

(52) U.S. Cl.
USPC ..... 508/154; 508/156; 508/161; 508/165

(58) Field of Classification Search
USPC ..... 508/107, 110, 136, 137, 154, 155, 508/173
See application file for complete search history.

(56) References Cited

U.S. PATENT DOCUMENTS

| | | | |
|---|---|---|---|
| 3,428,464 | A | 2/1969 | Pollard |
| 5,983,689 | A | 11/1999 | Yorifuji |

FOREIGN PATENT DOCUMENTS

| | | |
|---|---|---|
| JP | 63-234092 | 9/1988 |
| JP | 7-45056 B2 | 5/1995 |
| JP | 08-311479 | 11/1996 |
| JP | 10-130687 | 5/1998 |
| JP | 2001-234189 | 8/2001 |

*Primary Examiner* — Taiwo Oladapo
(74) *Attorney, Agent, or Firm* — Clark & Brody

(57) ABSTRACT

A method of coating uses an anti-seizure agent for hot steel working that exhibits excellent wettability and surface film-adherability. The agent comprises: an inorganic component (first component); sodium hydroxide (second component); water-soluble resins and/or water-soluble surfactants (third component); and water. With the sum of the first component, the second component, and the third component as 100 mass %, the anti-seizure agent contains: 96.5 mass % or more and 99.98 mass % or less of the first component; 0.01 mass % or more and 2.0 mass % or less of the second component; and 0.01 mass % or more and 1.5 mass % or less of the third component, and the inorganic component is one or more selected from a group consisting of $Al_2O_3$, $SiO_2$, CaO, $B_2O_3$, $K_2O$, and $Na_2O$. A coating layer formed solidly adheres to the steel and does not come off in both cold and hot working.

8 Claims, No Drawings

ANTI-SEIZURE AGENT FOR HOT STEEL WORKING

RELATED APPLICATION

This application is a division of Ser. No. 11/887,512 filed Aug. 11, 2009 now U.S. Pat. No. 8,263,534 which is a national stage entry of PCT/JP2006/306200 filed Mar. 27, 2006 which claims priority from Japanese Patent Application No. 2005-105360, filed Mar. 31, 2005, which is incorporated by reference in its entirety.

TECHNICAL FIELD

The present invention relates to an anti-seizure agent for hot metal working for steel plates and steel pipes or tubes (hereinafter, refer to "pipes" as "pipes or tubes"). Specifically, when a billet or a hollow shell is processed in a hot working of manufacturing seamless pipes, the present invention relates to an anti-seizure agent for the hot metal working for inhibiting seizure caused between a material to be processed and tools for hot working to inhibit occurrence of flaws on the surface of the processed material, and for improve the products' surface quality.

BACKGROUND ART

An example with harsh environment among the processes of hot steel working may be piercing-rolling as one of the processes of seamless pipes manufacturing. A tilt-rolling apparatus used in the piercing-rolling process of the seamless steel pipes is, for example, mainly constituted of a pair of tilted rolls and a pair of guides. In order to prevent the enlargement of the billet's outer diameter becoming more than necessary during the piercing-rolling, the pair of guides are oppositely disposed such that the both guides come to the position at an angle of 90° around the pipe passage centerline with respect to the tilted rolls. As the guides, plate shoe type guides or disk-roll type guides are usually used. Since a billet is rotating while moving forward, no matter which type of guides are used, the billet slides in the pipe's circumferential direction to the guides. Moreover, when plate shoe type guides are used, as the guides are fixed in the pipe's axial direction, slide of the billet to the guides increases in the pipe's axial direction. If the billet proceeds in sliding engagement with the guides, seizure is caused on the contact surface of billet and guides. After rolling of the steel pipe, surface flaws attributed to the seizure are produced on the surface of steel pipe. Therefore, lubrication treatment is needed to the contact surface of the billet and guides.

Patent Document 1 discloses a lubricant for the use of such lubrication treatment as above, the lubricant consists of iron oxide, alumina, magnesia, silica, and a binder. Patent Document 1 also discloses a method for coating this lubricant on the surface of a material to be processed before heating process prior to the hot metal working.

Patent Document 1: Japanese Patent Application Examined No. 07-45056

DISCLOSURE OF THE INVENTION

Problems to be Solved by the Invention

Conventional lubricants, as the undiluted lubricants are water-soluble, have a problem that the steel tends to reject the lubricants when coated. In addition, the lubricants have another problem that lubrication coatings formed by drying the applied lubricants come off.

In the manufacturing process of seamless steel pipes, automatic transportation lines are adopted. On the transportation lines, billets and rollers for transporting thereof frequently contact each other. So, a coating formed on the surface of billets tends to mechanically come off by the vibration and impact during the transportation. Thus, in the manufacturing process of seamless steel pipes, it is important to solidly adhere the lubrication coating to the steel surface.

A steel, on which a lubrication coating is formed by coating a lubricant and drying, is heated at high temperature (e.g. 1100° C. or more) in a heating furnace before hot metal working. In this phase, even though the lubricant is sufficiently dried before taking the above steel into the heating furnace, if certain component containing crystal water (e.g. crystal water such as water glass) is contained in the lubricant, the crystal water is suddenly boiled during the heating. Thereby the lubrication coating may come off. As a reference, a lubricant described in Patent Document 1 includes diluted silicate of soda ($Na_2SiO_3$) with water (so-called "water glass".) as a binder.

Because of the above problems, when conventional lubricants are used, seizure of steel in the hot metal working cannot be sufficiently inhibited. Therefore, flaws attributed to the seizure are inevitably produced on the surface of steel products. Especially, in the manufacturing process of seamless steel pipes, the seizure flaws are frequently produced on the surface of the pipes.

Accordingly, an object of the present invention is to provide an anti-seizure agent for hot steel working, wherein the anti-seizure agent exhibits favorable wettability and firm-adherability to the steel surface, the coating layer formed after coating the anti-seizure agent adheres to the steel solidly, and the layer does not come off under the cold and hot environment.

The wording "cold" means a condition where the material to be processed such as steel is at room temperature; while, the wording "hot" means a period and condition from the heating of the material to be processed at a temperature of 1100~1300° C. to the completion of the metal working in a predetermined product shape.

Means for Solving the Problems

One aspect of the present invention is an anti-seizure agent for hot steel working comprising: an inorganic component as a first component; sodium hydroxide as a second component; water-soluble resins and/or water-soluble surfactants as a third component; and water, wherein, to the mass of the sum of the first component, the second component, and the third component as 100 mass %, the anti-seizure agent contains: 96.5 mass % or more and 99.98 mass % or less of the first component; 0.01 mass % or more and 2.0 mass % or less of the second component; and 0.01 mass % or more and 1.5 mass % or less of the third component, and the inorganic component is one or more selected from a group consisting of $Al_2O_3$, $SiO_2$, CaO, $B_2O_3$, $K_2O$, and $Na_2O$.

The anti-seizure agent for hot steel working of the invention exhibits excellent wettability and surface firm-adherability when coated on the surface of a material to be processed. Further, once the anti-seizure agent for hot steel working is coated and dried on the surface of a material to be processed, an anti-seizure coating layer (hereinafter, it may be referred as "coating layer".) is formed and this coating layer solidly adheres to the surface of steel and does not come off from the surface of the steel. Therefore, for example, when a billet is pierced and rolled, since the coating layer does not come off from the billet's surface, it is capable to effectively inhibit seizure.

In one aspect of the invention, to the total mass of the inorganic component as 100 mass %, the inorganic component preferably contains: 30 mass % or more and 70 mass % or less of $Al_2O_3$, 35 mass % or more and 80 mass % or less of $SiO_2$, O mass % or more and 1.0 mass % or less of CaO, 0.05 mass % or more and 2.0 mass % or less of $B_2O_3$, 0 mass % or more and 0.5 mass % or less of $K_2O$, and 0.02 mass % or more and 1.0 mass % or less of $Na_2O$. If the inorganic component has the above composition, it is capable to make a part of the inorganic component low melting point and low viscosity.

In one aspect of the invention, the inorganic component consists of a ceramic base material and an inorganic binder, and the inorganic binder may be fine powder of frit. Moreover, apart of the ceramic base material may be fine powder of frit. For instance, silicon oxide as the ceramic base material can be made into fine powder of frit together with the inorganic binder. Accordingly, in the present invention, the wording "(the) inorganic binder is fine powder of frit" may also includes an aspect such that a part of the ceramic base material is made into fine powder of frit together with the inorganic binder.

In this way, by making the inorganic binder (it may include a part of ceramic base material.) as a part of inorganic component into a form of frit, it is capable to make the inorganic binder low melting point and lower viscosity. In the hot working, fine powder of this frit is melted and the melted powder enters into pore spaces of ceramic base material (the "ceramic base material" in this hot working means a ceramic base material other than the ceramic base material made into fine powder of frit.), then it reacts with the surface of ceramic base material. Accordingly, it is capable to form a dense and solid coating layer. The wording "frit" means powder glass manufactured by the steps of: mixing and melting certain individual components in advance, suddenly cooling the melted mixture in water or in the atmosphere, and pulverizing or milling the cooled mixture.

The anti-seizure agent for hot steel working according to one aspect of the invention may further include metallic cobalt and/or metallic nickel as a fourth component; content thereof is 0.1~10 mass % to the total mass of the inorganic component (100 mass %). By including the metallic cobalt and/or metallic nickel as a fourth component, it is possible to improve firm-adherability and adhesiveness of the coating layer to be formed.

The anti-seizure agent for hot steel working according to one aspect of the invention may further include fine powder of a cobalt compound and/or a nickel compound as a fifth component; content thereof is 0.01~1 mass % to the total mass of the inorganic component as 100 mass %. By including the cobalt compound and/or the nickel compound as the fifth component, it is possible to improve the firm-adherability and adhesiveness of the coating layer to be formed.

Another aspect of the invention is a method for hot steel working comprising the steps of: coating an anti-seizure agent described above at room temperature on a surface of a material to be processed; drying the anti-seizure agent being coated and forming a coating layer on the surface of the material to be processed; and carrying out hot metal working by use of the material the coating layer is formed thereon. In the method, the coating layer formed by coating the anti-seizure agent of the invention on the surface of the material to be processed solidly adheres to the surface of the material to be processed. The adhered coating layer does not come off from the material to be processed during the hot metal working, thereby the coating layer can inhibit seizure of the steel products.

Another aspect of the invention is a method for inhibiting seizure of steel during piercing-rolling process comprising the steps of: coating an anti-seizure agent described above at room temperature on a surface of a material to be processed; drying the anti-seizure agent being coated and forming a coating layer on the surface of the material to be processed; and carrying out piercing-rolling the material the coating layer is formed thereon. Further, another aspect of the invention is a method for manufacturing seamless steel pipes comprising the steps of: coating an anti-seizure agent described above at room temperature on a surface of a material to be processed; drying the anti-seizure agent being coated and forming a coating layer on the surface of the material to be processed; and carrying out piercing-rolling the material a coating layer is formed thereon.

Using these methods, the coating layer formed by coating the anti-seizure agent of the present invention on the surface of material to be processed solidly adheres on the surface of the material, the layer does not come off from the material to be processed during the piercing-rolling process. This allows the coating layer to stay at the sliding interface between the material to be processed and the tools; therefore it is possible to inhibit seizure of the material and the tools. Thus, seamless steel pipes can be manufactured without having seizure flaws.

BEST MODE FOR CARRYING OUT THE INVENTION

The anti-seizure agent for hot steel working of the present invention comprises: the first component; the second component; the third component; and water.

<The First Component>

An inorganic component as the first component is a mixture of a ceramic base material and an inorganic binder. The amount of the first component is preferably 96.5 mass % or more and 99.98 mass % or less, to the sum (100 mass %) of the first component, the second component, and the third component.

The inorganic component is, to total mass (100 mass %) of the inorganic component, preferably composed of: 30 mass % or more and 70 mass % or less of $Al_2O_3$, 35 mass % or more and 80 mass % or less of $SiO_2$, O mass % or more and 1.0 mass % or less of CaO, 0.05 mass % or more and 2.0 mass % or less of $B_2O_3$, O mass % or more and 0.5 mass % or less of $K_2O$, and 0.02 mass % or more and 1.0 mass % or less of $Na_2O$. In order to have such composition, it is preferable to mix ceramic base material and inorganic binder.

By making the composition of the inorganic component consisting of the mixture of ceramic base material and inorganic binder, it is capable to make the property of inorganic component low melting point and lower viscosity. CaO and $K_2O$ are optional component, it is not necessarily contained in the inorganic component.

(Ceramic Base Material)

Ceramic base material is a base material consisting of aluminum oxide or silicon oxide, or a mixture thereof. The ceramic base material is a main component of the coating layer formed on the surface of the material to be processed; it secures an effect of heat-resistance for the coating layer after drying. The above ceramic base material is preferably mixed at a ratio of 90 mass % or more, to the total mass (100 mass %) of first component. Because, when the amount of ceramic base material is too small, heat-resistance of the coating layer formed after drying becomes poor, and the anti-seizure effect of the anti-seizure agent is deteriorated. As an embodiment of the above ceramic base material, for example, there may be kaolin ($Al_2O_3.2SiO_2.2H_2O$) which is a mixture of aluminum oxide and silicon oxide.

(Inorganic Binder)

The inorganic binder composing of the inorganic component for the first component is a glass component which melts in the heating process prior to the hot metal working and acts as adhesive during the hot working. The inorganic binder, to total mass (100 mass %) of inorganic binder, preferably contains 30 mass % or more and 40 mass % or less of $SiO_2$, 5 mass % or more and 10 mass % or less of $Al_2O_3$, 30 mass % or more and 40 mass % or less of $B_2O_3$, 0 mass % or more and 5 mass % or less of CaO, 10 mass % or more and 20 mass % or less of $Na_2O$, and 0 mass % or more and 5 mass % or less of $K_2O$. Cao and $K_2O$ are optional components.

$SiO_2$ is a main component of glass. The inorganic binder forms a mixed glass of which borosilicate glass (e.g. Si, B, Na), alumina silicate glass (e.g. Si, Al, Na), and silicate glass are melted and solidified.

By preparing the inorganic binder having composition within the above range, it is capable to make the mixture of ceramic base material and inorganic binder for forming the first component into the one with low melting point and low viscosity. Particularly, $B_2O_3$ and $Na_2O$ act to lower the melting points, CaO and $K_2O$ lower the viscosity (however, if CaO and K2O are excessive, slippage is caused between the material to be processed and the tool for hot working during the hot metal working).

While, an alkali metal component contained in the inorganic binder reacts with iron oxide existing on the surface of the material to be processed. A small reacted portion caused by this realizes anchor effect, therefore adhesiveness and peel-resistance of the coating layer to the material to be processed are further improved.

As a substitution of the inorganic binder of the present invention, other anti-seizure agents having components such as $B_2O_3$ actually exist. Nevertheless, as the inorganic binder of the present invention is glass powder of ready-calcinated borosilicate component which does not have any volatile components, it is different from other anti-seizure agents. Specific difference of the inorganic binder of the present invention from that is: for instance, non-foamable at high temperature; uniformed component condition because of the low melting point and low viscosity. Further, this binder has an effect as an adhesive with a little additive amount during hot working.

The inorganic binder is, to total mass of the first component (100 mass %), preferably mixed at a ratio of 0.05 mass % or more and less than 10 mass %. Because, when the amount of inorganic binder is too small, an effect as an adhesive in the hot working, as it were, an effect to inhibit coming off of the coating layer is hard to be realized. On the other hand, when the amount of inorganic binder is excessive, heat-resistance of the coating layer is deteriorated.

In the inorganic binder, $SiO_2$ and $Na_2O$ may be provided in a form of water glass. In such a case, the water glass is preferably used by removing the water therein in accordance with the following steps. The water glass is heated up to about 1000° C. together with other inorganic components, then, it is cooled down and pulverized.

Water of the inorganic binder of the first component may be removed in advance by making it into fine powder of frit. If the inorganic binder is treated as such, when a material to be processed which anti-seizure agent is coated on the surface is heated, it is possible to inhibit boiling of water in the anti-seizure agent and the coming off of the coating layer because of that. Alternatively, together with the inorganic binder, a part of the ceramic base material may be made into fine powder of frit. For example, silicon oxide as a ceramic base material may be made into fine powder of frit together with inorganic binder. In the invention, the wording "the inorganic binder is fine powder of frit." means that an embodiment, which a part of the ceramic base material is made into fine powder of frit together with the inorganic binder, is also included.

Further, by making the inorganic binder (a part of the ceramic base material may be included depending on the cases.) into fine powder of frit, it is capable to make glass powder with low melting point and low viscosity. The melting point of this fine powder of frit is about 700~800° C., which is low. And the fine powder of frit is glass powder with low viscosity. Therefore, the inorganic binder is melted in the furnace by heating (at a temperature of about 1100~1300° C.) prior to the hot metal working, a part of the inorganic binder comes into the pore spaces of the ceramic base material and reacts with the surface of the ceramic base material. And, other part of the inorganic binder comes to stay on the surface of the material to be processed. Hence, a coating layer having excellent adhesiveness with a steel surface at high temperature and being dense and solid is formed.

The wording "frit" means a powder glass being made from the steps of: mixing and melting individual components in advance, cooling down in water or in the atmosphere, and pulverizing or milling thereof. When the inorganic binder is made into a form of frit, due to the melting and mixing in advance, and following eutectic reaction, melting point of the obtained frit is lowered from those of the individual components. Because of this, if the inorganic binder is used in a form of frit, compared with the case when individual components are added as they are, it can stably exist as an anti-seizure agent. In addition, when water or crystal water is contained in the individual components and the individual components are mixed as they are, the obtained coating layer is easily peeled when heated due to the boiling of the contained water and so on. While, being a form of frit, the inorganic binder does not have a fear of peeling in relation to the water-boiling and so on.

The inorganic component as the first component of the anti-seizure agent of the invention is preferably powder component; the particle diameter is preferably moderately rough in terms of better drying property of the anti-seizure agent. In other words, if the particle diameter is moderately rough, evaporation rate of water is faster, thus it is preferable. However, from the viewpoint of anti-seizure performance such as uniform mixing and dispersion performances of each component, adhesiveness to the surface of the material to be processed, uniform coatability, and surface smoothness, the particle diameter is preferably smaller to the certain extent. Because of these, the particle diameter of the first component as a particle component is preferably 0.1 μm or more and 30 μm or less, particularly preferably, 1 μm or more and 10 μm or less.

(The Fourth Component)

The anti-seizure agent of the present invention may further contain metallic cobalt and/or metallic nickel as the fourth component; the content thereof is, to total mass (100 mass %) of the inorganic component, preferably 0.1~10 mass %. When metal cobalt and/or metal nickel are contained, firm-adherability and adhesiveness of the coating layer is improved.

Average particle diameter of the metallic cobalt and metallic nickel is preferably 0.1 μm or more and 20 μm or less. If the particle diameter is too large, when the anti-seizure agent is prepared, it becomes difficult to disperse the particles in the water.

(The Fifth Component)

The anti-seizure agent of the present invention may furthermore contain a cobalt compound and/or a nickel compound as the fifth component; the content thereof is, to total mass (100 mass %) of the inorganic component, preferably 0.01~1 mass %. The cobalt compound and/or the nickel compound as the fifth component may be used alone or in combination of two or more thereof. The fifth component, if possible, preferably made into a form of fine powder of frit in the same way as the above inorganic binder, as required.

As the fifth component, when a cobalt compound and/or a nickel compound are included, firm-adherability and adhesiveness of the coating layer are improved. Examples of the cobalt compound and the nickel compound include oxide, hydroxide, carbonate, sulfate salt, and chloride of cobalt and nickel. Moreover, when the cobalt oxide and the nickel oxide are used for instance, a glass fine powder with low melting point (m.p. 700~800° C.) and low viscosity may be used. Such fine powder can be obtained by uniformly mixing cobalt oxide and the nickel oxide, melting and vitrifying the mixture at a temperature of 800~1000° C., then quickly cooling the vitrified product and pulverizing it.

The average particle diameter of the cobalt compound and the nickel compound is preferably 0.1 μm or more and 20 μm or less. If the particle diameter is too large, it becomes difficult to disperse in water at a time of preparation of anti-seizure agent.

<The Second Component>

The second component of the anti-seizure agent of the present invention is sodium hydroxide. Sodium hydroxide becomes sodium oxide in hot working; this sodium oxide reacts with silicon oxide, specifically silicon oxide in the first component at high temperature, then the sodium oxide gradually becomes sodium silicate. Therefore, the behavior of sodium hydroxide at high temperature is same as that of water glass. This sodium hydroxide acts as an adhesive at high temperature of the heating process before the hot metal working. Further, compared with water glass, since sodium hydroxide can make contained water easily evaporated; there is an advantage of non-foamable.

In the anti-seizure agent of the invention, the second component, to the total (100 mass %) of the first component, the second component, and the third component, is mixed at a ratio of 0.01 mass % or more and 2.0 mass % or less. However, if content of sodium hydroxide is excessive, excessive amount of sodium component possibly causes alkali corrosion at high-temperature to the steel surface. Further, if content of sodium hydroxide is excessive, the anti-seizure agent becomes high alkali, which is difficult to handle, thereby it worsen the workability. Thus, content of sodium hydroxide is preferably small within the above range.

<The Third Component>

The anti-seizure agent of the present invention contains water-soluble resins and/or water-soluble surfactants as the third component. The water-soluble resins act as an adhesive and a spreading agent when the anti-seizure agent is coated on the surface of the material to be processed at room temperature. The resins can enhance the elastic modulus of the coating layer formed after drying, it is capable to prevent the coating layer from having cracks. While, the water-soluble surfactants give wettability and dispersion stability to the inorganic component of the first component of the invention. The surfactants also enhance slidability of the anti-seizure agent when coated at room temperature on the surface of the material to be processed. Having these resins and surfactants as the third component, it is capable to uniformly coat the anti-seizure agent on the surface of the material to be processed and to make the coated surface smooth. It is also capable to prevent the coating layer after drying from having occurrence of cracks.

As the water-soluble resins, alkyd resin, polyvinyl alcohol, poly acrylic acid ester, and so on can be used. Also, as the water-soluble surfactants, dialkyl sulfosuccinic acid ester, and sodium salt or triethylamine (TEA) salt of polyoxyethylene alkylethereal sulfate, polyoxyethylene alkylether, and so on can be used. These resins and surfactants are both organic compounds. Therefore, even though they are suddenly carbonized at high temperature and react with steel as reducing agents temporarily, they become the cause of occurrence of minute gas cavity of steel surface if the amount is excessive. Hence, in the anti-seizure agent, the third component to the total (100 mass %) of the first component, the second component, and the third component, is mixed at a ratio of 0.01 mass % or more and 1.5 mass % or less.

If the coating layer has minute gas cavities and cracks, a coating layer obtained by applying the anti-seizure agent on the material to be processed and drying the coating easily causes large and small sized peeling from the gas cavities and cracked areas at high temperature. As a result, lubricity of the material to be processed declines and seizure quickly spreads. Therefore, the coating layer formed by applying the anti-seizure agent is required to solidly and uniformly adhere on the surface of the steel and to have heat-resistance as well as dense at high temperature to completely shut out the outer air. For example, in the production lines of seamless steel pipes, when a billet on which the coating layer is formed is transported to the heating furnace, when the transported billet is fed into the heating furnace, during heating, and when the heated billet is taken out from the heating furnace and transported to the piercing-rolling process, the formed coating layer is required to come off as little as possible. While, in the piercing-rolling process, the formed coating layer is required to sufficiently stay at the sliding interface between tools such as guides and the material to be processed.

In the anti-seizure agent of the invention, in order to solve the problems, when the anti-seizure agent is applied on the steel surface at room temperature, the third component acts as an adhesive at room temperature. Thereby the anti-seizure agent favorably adheres to the material to be processed, the anti-seizure agent also becomes excellent in spreading and drying property. The coating layer formed on the surface of the material to be processed after drying is high in elasticity and is solid enough not to be easily peeled.

In addition, when the coating layer is formed on the surface of the material to be processed and burnt in a furnace at high temperature, an inorganic binder as an adhesive at high temperature enters into the pore spaces of the ceramic base material forming the first component. The surface of the ceramic base material and a part of the inorganic binder react with each other. Other part of the inorganic binder is fixed on the surface of the material to be processed. Because of this, it is possible to form a dense and solid coating layer, which is excellent in adhesiveness with the material to be processed and in heat-resistance, on the surface of the material to be processed.

<Method for Hot Steel Working>

A method for hot steel working by use of the anti-seizure agent of the present invention will be described as follows. Firstly, before heating a material to be processed, the material is spray-coated or coated by brush on the surface thereof with the above-described anti-seizure agent of the invention at room temperature. This coating is dried and water in the anti-seizure agent is removed to form a coating layer containing a ceramic base material on the surface of the material to be processed.

Later, the material to be processed on which the coating layer is formed is heated so as to carry out the hot steel working. According to the method for hot steel working, the coating layer, which is excellent in surface firm-adherability and peel-resistance, does not come off from the surface of the material being processed in the hot metal working and still exists on the surface thereof. Therefore, seizure of the material being processed is inhibited.

<Method for Manufacturing Seamless Steel Pipes>

In the method for manufacturing seamless steel pipes by use of the anti-seizure agent of the present invention, the anti-seizure agent is spray-coated or coated by brush on the outer surface of the billet of high-alloy steel and the like before heating. The coated anti-seizure agent is dried for removing water therein to form a coating layer containing a ceramic base material on the surface of the billet. Later, the billet on which the coating layer is formed is heated and piercing-rolled by a rolling mill. At this point, the coating layer formed on the surface of the billet usually exists on the sliding interface between the billet and guides, therefore seizure of the billet and guides can be inhibited. In this way, it is capable to manufacture seamless steel pipes having almost no seizure flaws.

In the method for hot steel working and method for manufacturing seamless steel pipes of the invention, coating thickness of the anti-seizure agent as the thickness after drying is preferably 0.03 mm or more and 1.0 mm or less, particularly around 0.2 mm. If the coating thickness is too thin, sufficient seizure-resistant effect cannot be obtained. On the other hand, if the thickness is too thick, decline of evaporation rate of water and influence of air cavity tend to easily cause cracks, adhesiveness of the material to be processed and the coating layer is lowered, thereby peeling is easily caused. In terms of inhibiting peeling of the coating layer, application of anti-seizure agent must be uniformly carried out as much as possible with certain coating thickness. The anti-seizure agent of the invention is extremely excellent in adhesiveness, dense, and heat-resistance, even though the coating is carried out in wide range of thickness, it is capable to obtain a uniform coating with certain thickness.

In the method for hot steel working and method for manufacturing seamless steel pipes of the invention, the coating layer to be formed must exist on the surface of the material to be processed at the early stage of the hot steel working. For example, it is required for the coating layer to exist on the sliding interface between a billet and guides. However, in order to make the appearance of final products, after working, the coating layer is preferably come off from the surface of the material worked. The anti-seizure agent of the invention also meets such needs.

EXAMPLES

Making the Anti-Seizure Agent

Example 1

As the first component, 98 parts by mass of kaolin (the equivalent amount of the component excluding crystal water; mole ratio of $Al_2O_3$ and $SiO_2$=1:2) as a ceramic base material, 2 parts by mass of glass powder (average particle diameter: 5 μm) as an inorganic binder having a composition of $Al_2O_3$ (8.0 mass %), $SiO_2$ (36.5 mass %) CaO (3.0 mass %), $B_2O_3$ (35.0 mass %), $K_2O$ (2.5 mass %), $Na_2O$ (15.0 mass %) (mass % in the brackets are values calculated based on the total of inorganic binder as 100 mass %.); as the second component, 0.015 parts by mass of sodium hydroxide; as the third component, 0.5 parts by mass of alkyd resin as a water-soluble resin, and 80 parts by mass of water were mixed so as to make the anti-seizure agent of the present invention.

Example 2

Except for changing the amount of sodium hydroxide of the second component to 0.2 parts by mass, the anti-seizure agent of the invention was made in the same way as Example 1.

Example 3

Except for changing the amount of sodium hydroxide of the second component to 1.0 part by mass, the anti-seizure agent of the invention was made in the same way as Example 1.

Example 4

As the first component, a ceramic base material without having inorganic binder only, 45.0 parts by mass of $Al_2O_3$, and 53.3 parts by mass of $SiO_2$; as the second component, 1.0 parts by mass of sodium hydroxide; as the third component, 0.7 parts by mass of polymethyl acrylate, and 70 parts by mass of water were mixed to make the anti-seizure agent of the invention.

Example 5

Except for making the entire inorganic binder in the first component of Example 1 into a form of frit powder, the anti-seizure agent of the invention was made in the same way as Example 1.

Example 6

Except for making the entire inorganic binder in the first component of Example 2 into a form of frit powder, the anti-seizure agent of the invention was made in the same way as Example 2.

Example 7

In Example 1, except for further adding 2 parts by mass of metallic cobalt powder (average particle diameter 5 μm) as the fourth component, the anti-seizure agent of the invention was made in the same way as Example 1.

Example 8

In Example 1, except for further adding 0.1 parts by mass of nickel oxide powder (average particle diameter 1 μm) as the fifth component, the anti-seizure agent of the invention was made in the same way as Example 1.

Example 9

In Example 5, except for further adding 7 parts by mass of metallic nickel powder (average particle diameter 0.5 μm) as the fourth component, the anti-seizure agent of the invention was made in the same way as Example 5.

Comparative Example 1

In Example 1, except for the point that sodium hydroxide as the second component is not added, the anti-seizure agent of the invention was made in the same way as Example 1.

Comparative Example 2

In Example 1, except for the point that an organic component as the third component is not added, the anti-seizure agent of the invention was made in the same way as Example 1.

Comparative Example 3

In Example 3, except for the point that an organic component as the third component is not added, the anti-seizure agent of the invention was made in the same way as Example 3.

Comparative Example 4

In Example 1, except for the point that a ceramic base material is not added, the anti-seizure agent of the invention was made in the same way as Example 1.

<Evaluation Method>

Anti-seizure agents made based on the above Examples and Comparative examples, and coating layers formed by applying these anti-seizure agents onto the steel, were evaluated in accordance with the following criteria.

(Wettability)

The anti-seizure agent was applied with the coating amount of 2 kg/m$^2$ by brush onto stainless-steel plate test-pieces of which surface were smoothly ground. When the anti-seizure agent existed on the entire surface of the steel plate without widely repelling, it was evaluated as good: "○". While, in a part of the steel plate, if the anti-seizure agent is repelled and does not exist at the particular areas, it was evaluated as poor: "x". The evaluation results are shown in Table 1.

(Surface Firm-Adherability)

After naturally drying the anti-seizure agent coated on the steel-plate test-pieces, commercially available cellophane tape for stationery usage was put and taken away on the test-pieces. When the anti-seizure agent on a steel-plate test-piece was not peeled by the cellophane tape, it was evaluated as good: "○". While, if the anti-seizure agent was peeled by the cellophane tape, it was evaluated as poor: "x". The evaluation results are shown in Table 1.

The anti-seizure agent of which result in wettability or surface firm-adherability is poor can not form a coating layer on the entire surface of a billet as an actual material to be processed, therefore the following evaluations were not carried out for them.

(Peel-Resistance of the Coating Layer (Cold Working))

To a billet of 225 mm in outer diameter, the anti-seizure agent was applied by brush with the amount of 2 kg/m$^2$ and dried to form a coating layer. When the billet was transported by transporting rollers and the like, coating layer of a billet without being peeled was evaluated as good: "○", and coating layer of a billet being peeled was evaluated as poor: "x". The transporting rollers were 400 mm in outer diameter of circular arc shape; the total distance for transportation was about 30 m. The evaluation results are shown in Table 1.

(Peel-Resistance of the Coating Layer (Hot Working))

A billet on which a coating layer had been formed was heated at about 1200° C. in a heating furnace; then it was transported to the piercer in hot atmosphere. The transporting rollers were 400 mm in outer diameter of circular arc shape, the transported distance for this evaluation was 30 m. After transportation of this distance, the transported billet was left to cool without rolling, and remained anti-seizure agent was observed. The surface scale was visually observed; if the remaining area of the anti-seizure agent in white was 90% or more to the total area where the anti-seizure agent was applied, it was evaluated as very good: "◎". If it was 80% or more, it was evaluated as good: "○". If it was less than 80%, it was evaluated as poor: "x". The evaluation results are shown in Table 1.

<Manufacturing of Steel Seamless Pipes>

The anti-seizure agents made in accordance with the above Examples and Comparative examples were coated by brush at room temperature with the amount of about 1 kg/m$^2$. The anti-seizure agent being coated was dried naturally to form a coating layer. A billet on which a coating layer was formed was heated at about 1200° C., and piercing-rolled by use of tilt-rolling apparatus having disk-roll type guide shoes to manufacture a seamless steel pipe.

(Seizure-Resistance)

Each anti-seizure agent made in accordance with the above Examples and Comparative examples was tested by piercing-rolling with ten billets each. Then, if two or more seizure flaws were produced on the surface of the billet with the guide shoes, it was evaluated as poor: "x"; if one flaw was produced, it was evaluated as good: "○"; and if zero flaw was produced, it was evaluated as very good: "◎". The evaluation results are shown in Table 1.

(Comprehensive Evaluation)

Seeing the above evaluation results comprehensively, examples obtained "◎" and "○" were marked as very good: "◎"; examples obtained "○" in all items were marked as good: "○"; and examples obtained at least one "x" were marked as "x". The unit of values in Table 1 is represented with parts by mass.

(Results)

TABLE 1

| | Ceramic base material | Inorganic binder | Sodium hydroxide | Water-soluble resins | Water | Metallic powder | Nickel compound | Wettability | Surface firm-adherability | Peel-resistance (cold working) | Peel-resistance (hot working) | Seizure-resistance | Comprehensive Evaluation |
|---|---|---|---|---|---|---|---|---|---|---|---|---|---|
| Example 1 | 98 | 2 | 0.015 | 0.5 | 80 | — | — | o | o | o | o | o | o |
| Example 2 | 98 | 2 | 0.2 | 0.5 | 80 | — | — | o | o | o | o | o | o |
| Example 3 | 98 | 2 | 1.0 | 0.5 | 80 | — | — | o | o | o | o | o | o |
| Example 4 | 98.3 | — | 1.0 | 0.7 | 70 | — | — | o | o | o | o | o | o |
| Example 5 | 98 | 2 (frit) | 0.015 | 0.5 | 80 | — | — | o | o | o | ◎ | ◎ | ◎ |
| Example 6 | 98 | 2 (frit) | 0.2 | 0.5 | 80 | — | — | o | o | o | ◎ | ◎ | ◎ |
| Example 7 | 98 | 2 | 0.015 | 0.5 | 80 | 2 | — | o | o | o | ◎ | ◎ | ◎ |

TABLE 1-continued

| | Ceramic base material | Inorganic binder | Sodium hydroxide | Water-soluble resins | Water | Metallic powder | Nickel compound | Wet-tability | Surface firm-adher-ability | Peel-resistance (cold working) | Peel-resistance (hot working) | Seizure-resis-tance | Compre-hensive Eval-uation |
|---|---|---|---|---|---|---|---|---|---|---|---|---|---|
| Example 8 | 98 | 2 | 0.015 | 0.5 | 80 | — | 0.1 | o | o | o | ◎ | ◎ | ◎ |
| Example 9 | 98 | 2 (frit) | 0.015 | 0.5 | 80 | 7 | — | o | o | o | ◎ | ◎ | ◎ |
| Comparative example 1 | 98 | 2 | — | 0.5 | 80 | — | — | o | o | o | x | x | x |
| Comparative example 2 | 98 | 2 | 0.015 | — | 80 | — | — | x | x | — | — | — | x |
| Comparative example 3 | 98 | 2 | 1.0 | — | 80 | — | — | x | x | — | — | — | x |
| Comparative example 4 | — | 2 | 0.015 | 0.5 | 80 | — | — | o | o | o | o | x | x |

Each of the anti-seizure agent of the present invention (Examples 1~9) shows good result in all evaluation items. The coating layer formed by the anti-seizure agent of the invention was solidly adhered on the surface of the billet, peel-resistance in both cold and hot working was good, and seizure-resistance was also good. Moreover, when inorganic binder of the first component was made into a form of frit (Examples 5, 6, and 9), when metallic powder was added as the fourth component (Examples 7 and 9), and when a nickel compound was added as the fifth component (Example 8), peel-resistance and seizure-resistance in hot working were particularly favorable.

On the other hand, as sodium hydroxide as an adhesive at high temperature was not added, the anti-seizure agent of the Comparative example 1 was poor in peel-resistance and seizure-resistance. The anti-seizure agents of the Comparative examples 2 and 3 were poor in wettability and surface firm-adherability, as the third component, which acts as adhesive and spreading agent when applying the anti-seizure agent at room temperature, was not added. The anti-seizure agent of Comparative example 4 was poor in seizure-resistance, as ceramic base material as a component for securing heat-resistance of the coating layer to be formed was not added.

The above has described the present invention associated with the most practical and preferred embodiments thereof. However, the invention is not limited to the embodiments disclosed in the specification. Thus, the invention can be appropriately varied as long as the variation is not contrary to the subject substance and conception of the invention which can be read out from the claims and the whole contents of the specification. It should be understood that an anti-seizure agent for hot steel working, a method for hot steel working, and a method for manufacturing steel seamless pipe with such an alternation are included in the technical scope of the invention.

The invention claimed is:

1. A method for hot steel working comprising the steps of:

applying an anti-seizure agent comprising: an inorganic component as a first component; sodium hydroxide as a second component; water-soluble resins and/or water-soluble surfactants as a third component; and water, wherein, to the mass of the sum of said first component, said second component, and said third component as 100 mass %, said anti-seizure agent contains: 96.5 mass % or more and 99.98 mass % or less of said first component; 0.01 mass % or more and 2.0 mass % or less of said second component; and 0.01 mass % or more and 1.5 mass % or less of said third component, and at room temperature on a surface of a material to be processed;

drying said applied anti-seizure agent being coated thereby forming a coating layer on the surface of said material to be processed; and carrying out hot working of said material to be processed having said coating layer on the surface thereof, wherein, to the total mass of said inorganic component as 100 mass %, said inorganic component contains: 30 mass % or more and 70 mass % or less of $Al_2O_3$, 35 mass % or more and 80 mass % or less of $SiO_2$, O mass % or more and 1.0 mass % or less of CaO, 0.05 mass % or more and 2.0 mass % or less of $B_2O_3$, 0 mass % or more and 0.5 mass % or less of $K_2O$, and 0.02 mass % or more and 1.0 mass % or less of $Na_2O$.

2. The method of claim 1, wherein said inorganic component further contains 0.1 to 10 mass % of metallic cobalt and/or metallic nickel to the total mass of said inorganic compound as mass %.

3. The method of claim 1, wherein said inorganic component further contains 0.01 to 1 mass % of fine powder of a cobalt compound and/or a nickel compound to the total mass of said inorganic compound as 100 mass %.

4. The method of claim 1, wherein said inorganic component consists of a ceramic base material and an inorganic binder, said inorganic binder is fine powder of frit.

5. A method for manufacturing seamless steel pipes comprising the steps of:

applying an anti-seizure agent comprising: an inorganic component as a first component; sodium hydroxide as a second component; water-soluble resins and/or water-soluble surfactants as a third component; and water, wherein, to the mass of the sum of said first component, said second component, and said third component as 100 mass %, said anti-seizure agent contains: 96.5 mass % or more and 99.98 mass % or less of said first component; 0.01 mass % or more and 2.0 mass % or less of said second component; and 0.01 mass % or more and 1.5 mass % or less of said third component, and at room temperature on a surface of a material to be processed;

drying said applied anti-seizure agent being coated thereby forming a coating layer on the surface of said material to be processed; and carrying out piercing-rolling of said material to be processed having said coating layer on the surface thereof, wherein to the total mass of said inorganic component as 100 mass %, said inorganic component contains: 30 mass % or more and 70 mass % or less of $Al_2O_3$, 35 mass % or more and 80 mass % or less of $SiO_2$, O mass % or more and 1.0 mass % or less of CaO, 0.05 mass % or more and 2.0 mass % or less of $B_2O_3$, 0 mass % or more and 0.5 mass % or less of $K_2O$, and 0.02 mass % or more and 1.0 mass % or less of $Na_2O$.

6. The method of claim 5, wherein said inorganic component consists of a ceramic base material and an inorganic binder, said inorganic binder is fine powder of frit.

7. The method of claim 5, wherein said inorganic component further contains 0.1 to 10 mass % of metallic cobalt and/or metallic nickel to the total mass of said inorganic compound as mass %.

8. The method of claim 5, wherein said inorganic component further contains 0.01 to 1 mass % of fine powder of a cobalt compound and/or a nickel compound to the total mass of said inorganic compound as 100 mass %.

* * * * *